US005185962A

United States Patent [19]

Liou

[11] Patent Number: 5,185,962

[45] Date of Patent: Feb. 16, 1993

[54] BELT ROLLER ADJUSTMENT DEVICE OF BELT SANDER

[76] Inventor: John Liou, No. 7-5 9-Cha Lane Min Sheng Rd., Shang Feng Tsun Ta Ya, Taichung, Taiwan

[21] Appl. No.: 805,740

[22] Filed: Dec. 12, 1991

[51] Int. Cl.[5] ..... B24B 21/00

[52] U.S. Cl. ..... 51/148; 51/135 R

[58] Field of Search ..... 51/135 R, 148, 135 BT, 51/357, 170 EB

[56] References Cited

U.S. PATENT DOCUMENTS

| | | | |
|---|---|---|---|
| 1,108,176 | 8/1914 | Hormel | 51/148 |
| 2,740,238 | 4/1956 | Sharpless | 51/148 |
| 3,465,479 | 9/1969 | Foody et al. | 51/148 |
| 4,509,296 | 4/1985 | Rasmussen | 51/148 |
| 4,603,510 | 8/1986 | Rasmussen | 51/148 |

FOREIGN PATENT DOCUMENTS

| | | | |
|---|---|---|---|
| 2505236 | 11/1982 | France | 51/148 |

*Primary Examiner*—Robert A. Rose

*Attorney, Agent, or Firm*—Browdy and Neimark

[57] ABSTRACT

A belt roller adjustment device of belt sander comprises a sanding belt attached to the driving roller and the driven roller having a main shaft fastened to support rods having inner end portions thereof being threaded and fitted over with tubular sleeves. Two cams are used to urge the inner end portions of the tubular sleeves so as to exert a force on support rods to actuate the driven roller to move outwardly in order to tighten the sanding belt with speed and precision.

1 Claim, 2 Drawing Sheets

BELT ROLLER ADJUSTMENT DEVICE OF BELT SANDER

BACKGROUND OF THE INVENTION

The present invention relates to the belt roller of a belt sanding machine, and more particularly to a belt roller adjustment device capable of tightening or releasing rapidly the sanding belt and of adjusting the tightness of sanding belt with precision.

As shown in FIG. 1, the belt roller adjustment device of a conventional belt sander of prior art comprises a driving roller 11 and a driven roller 12, which are disposed respectively at the ends of machine seat 10 of the belt sander 1. A sanding belt 13 is fitted on the outer edges of these two rollers 11 and 12. The main shaft 14 of the driven roller 12 is provided at both ends thereof with support rods 15, each of which has a threaded end arranged on the two support rod seats 16 disposed correspondingly on the machine seat 10. Each of the threaded support rods 15 is provided with a nut 18, which can be rotated to adjust the length of the portion of the support rod 15 extending outside the machine seat 10 and to adjust the distance between the driving and the driven rollers 11 and 12 so as to release or tighten the sanding belt 13.

There are two operational defects of a belt sander of prior art as described above, which are further expounded hereinafter.

As described previously, the adjustment to release or to tighten the sanding belt is accomplished by means of rotating the nut of the threaded support rod. Such manual action of rotating the nut takes time and is therefore not practical from the operational point of view.

The adjustments of the two support rods of the driven roller are done separately and can result in an inconsistency with the lengths of portions of these two support rods extending outside the machine seat. As a result, the shaft center of the driven roller and the shaft center of the driving roller are not parallel. Under such circumstance, a potential safety hazard alway exists when the driven roller is actuated by the driving roller to spin at a high speed.

SUMMARY OF THE INVENTION

It is therefore the primary objective of the present invention to provide a belt sanding machine with belt roller adjustment device capable of releasing and tightening the sanding belt rapidly.

It is another objective of the present invention to provide a belt sander with belt roller adjustment device designed in such a way that the support rods of driven roller are actuated jointly so that the lengths of portions of the support rods extending outside the machine seat are always consistent and that the shaft centers of both driving and driven rollers always remain parallel to each other.

It is still another objective of the present invention to provide a belt sander with belt roller adjustment device, which comprises a precision adjustment sleeve intended to adjust individually the length of portion of the support rod of driven roller extending outside the machine seat.

It is still another objective of the present invention to provide a belt sanding machine with belt roller adjustment device comprising a recovery mechanism enabling the support rods of driven roller to withdraw inwardly upon the release of driven roller. In addition, such mechanism prevents the precision adjustment sleeve from displacing at the time when the belt is tightened.

In keeping with the principles of the present invention, the objectives of the present invention are accomplished by a belt roller adjustment device comprising a seat body, a sanding belt, a pair of support rod seats, a pair of support rods, a shaft, and a pair of cams. The seat body is composed of a driving roller and a driven roller respectively disposed pivotally at both ends thereof. The sanding belt is arranged on the edges of driving and driven rollers. The support rod seats are disposed at one end of the seat body in such a manner that they are positioned correspondingly to the driven roller. The inner end portions of support rods are arranged to the support rod seats in such a way that they are capable of moving back and forth along the axial direction of the support rods, while the outer end portions of support rods are arranged outside the support rod seats and are fastened to both ends of the main shaft of the driven roller. The shaft is disposed pivotally on the two opposite sides of the seat body. The cams are fastened securely to the shaft in such a manner that they are positioned correspondingly to the inner end portions of the support rods so as to deflect along with the shaft for a predetermined angle. As a result, the outer edges of the long axial ends of the cams urge the support rods to slide outwardly so as to increase the distance between the driving and the driven rollers for tightening the sanding belt. On the other hand, the cams can rotate to permit the long axial ends thereof to become disassociated with the inner end portions of the support rods so as to release the sanding belt.

The present invention is further provided with a pair of elastic pieces disposed between support rods and support rod seats in such a manner that they urge support rods to move inwardly so as to actuate the driven roller to move inwardly in order to shorten the distance between the driving and the driven rollers upon the departure of the long axial ends of cams from the inner end portions of the support rods.

The present invention is still further provided with a tubular sleeve disposed at the inner end portion of each of the two support rods. The inner end portion of the tubular sleeve is urged by the long axial end of the cam so that the length of the portion of outer end portion of support rod extending outside the support rod seat can be adjusted by means of rotating the tubular sleeve.

The present invention is still further provided with cams which comprise long axial ends having outer edges of tangential construction intended to urge the inner end portions of support rods to remain in a retained state.

DETAILED DESCRIPTION OF THE PREFERRED EMBODIMENT

Figure 2:
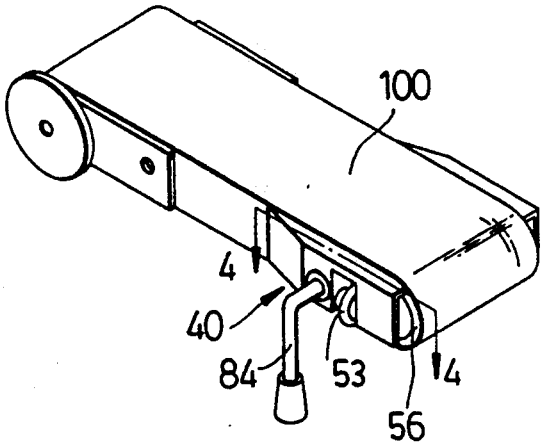
FIG. 2 shows a three-dimensional view of the preferred embodiment of the present invention.
Figure 3:
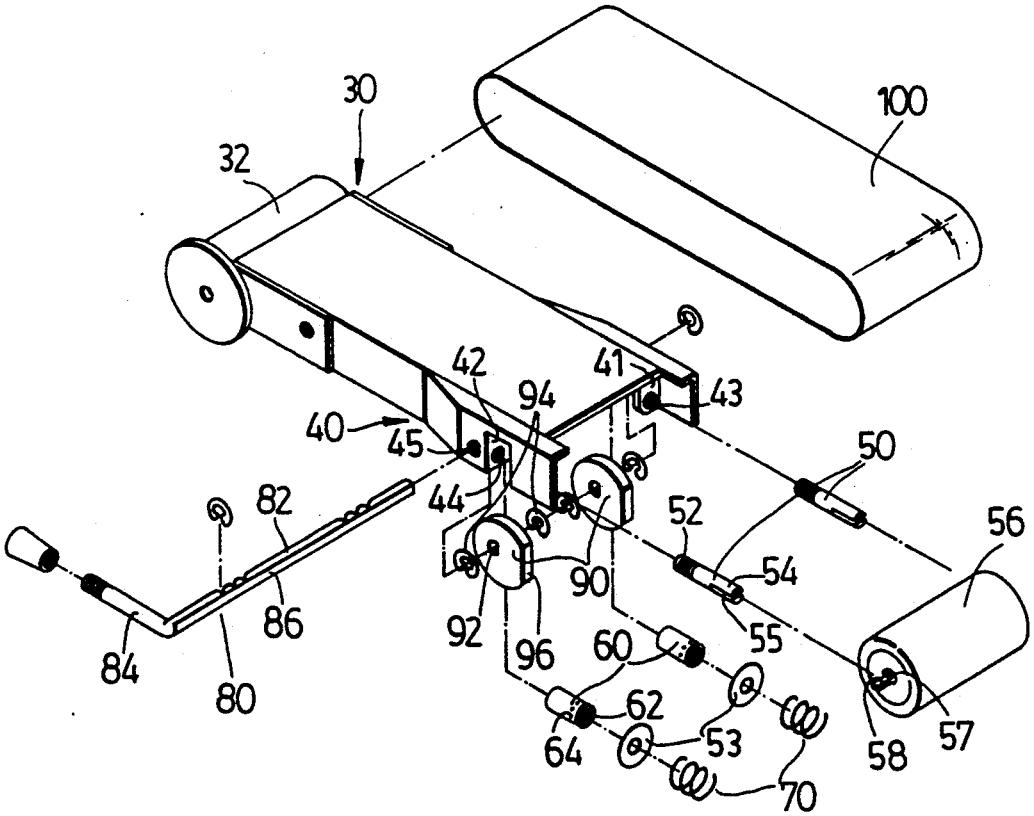
FIG. 3 shows an exploded view of the preferred embodiment of the present invention.

Referring to FIGS. 2 and 3, the preferred embodiment of the present invention is shown comprising a machine seat 30 with a driving roller 32 disposed pivotally at one end thereof, a pair of support rod seats 40 disposed correspondingly at both sides of the machine seat 30, a pair of support rods 50 provided with the threaded inner end portions 52 disposed inside the support rod seats 40 and with outer end portions 54 having a driven roller 56 disposed pivotally therebetween, a pair of tubular sleeves 60 fitted over the inner end portions 52 of support rods 50, a pair of coil springs 70 encasing support rods 50, a shaft 80 disposed pivotally and horizontally between the two support rod seats 40, and a pair of cams 90 fastened securely to the shaft 80.

Each of the support rod seats 40 is provided with a first lug 41 having a first axial hole 43 and a second lug 42 with a second axial hole 44. These two axial holes 43 and 44 are coaxially arranged and are parallel to the long axis of the machine seat 30. Each of the two support rod seats 40 is additionally provided coaxially with a third axial hole 45. These two third axial holes 45 are arranged in such a way that they are axially perpendicular to the first and the second axial holes 43 and 44.

Each of support rods 50 is fitted into the corresponding first axial hole 43 in such a manner that its outer end portion 54 is exposed to the outside of the machine seat 30. The outer end portions 54 of the support rods 50 are each provided with a retaining groove 55 intended to retain securely the retained block 58 of the main shaft 57 of the driven roller 56 so to permit the driven roller 56 to rotate pivotally outside the machine seat 30. The inner end portions 52 of the support rods 50 are threaded and are each fitted over with a washer 53.

The tubular sleeve 60 is provided at the outer end thereof with threaded hole 62 intended to engage inner end portion 52 of the support rod 50 and is fitted into the second axial hole 44 in such a manner that its inner end portion extends into the inner side of the second axial hole 44. The outer end portion of the tubular sleeve 60, which extends beyond the outer side of the second axial hole 44, comprises a plurality of the recessed holes 64 disposed on the circumference thereof and intended for use in turning the sleeve 60 by means of a hexagonal wrench (not shown in the drawings) by a person using the machine for the purpose of adjusting the length of outer end portion of the tubular sleeve 60 which extends beyond the second axial hole 44.

The coil spring 70 encases the support rod 50 in such a manner that it urges the inner side of the first lug 41 and the outer side of the washer 53. The stability of tubular sleeve 60 is ensured by the force of the coil spring 70 exerting on the washer 53 to resist the outer end portion of the tubular sleeve 60.

The shaft 80 comprises a shaft body 82 which is pivotally arranged between the two third axial holes 45 in such a manner that its one end extends beyond the machine seat 30 to form a handle 84. In addition, the shaft body 82 comprises axially a tangential surface 86.

The cam 90 is provided with a through hole 92 having an inner circumference with profile identical with the profile of the outer circumference of the cross section of the shaft body 82 of the shaft 80. As a result, the shaft body 82 of the shaft 80 can be fitted into the through holes 92 of the cams 90. The shaft body 82 of the shaft 80 is retained securely in the through hole 92 of the cam 90 by means of two pairs of C-shaped fastening rings 94. Each of these two cams 90 is further provided with a tangential surface 96 disposed on the portion of its circumference corresponding to the inner end portion of the tubular sleeve 60 and along the direction of its long axis.

Figure 1:
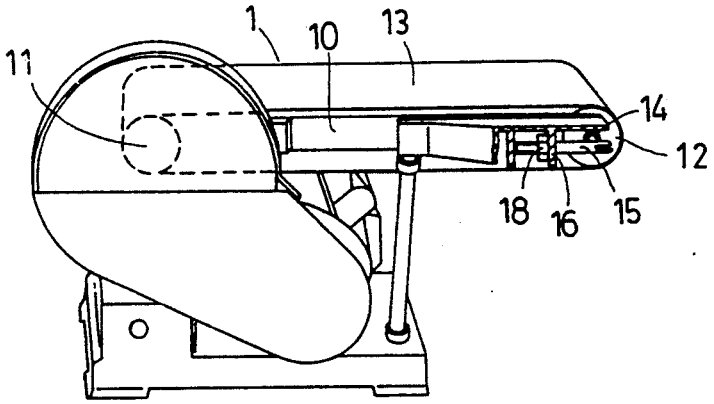
FIG. 1 PRIOR ART
FIG. 1 shows a three-dimensional schematic view of the belt sanding machine of prior art.
Figure 4:
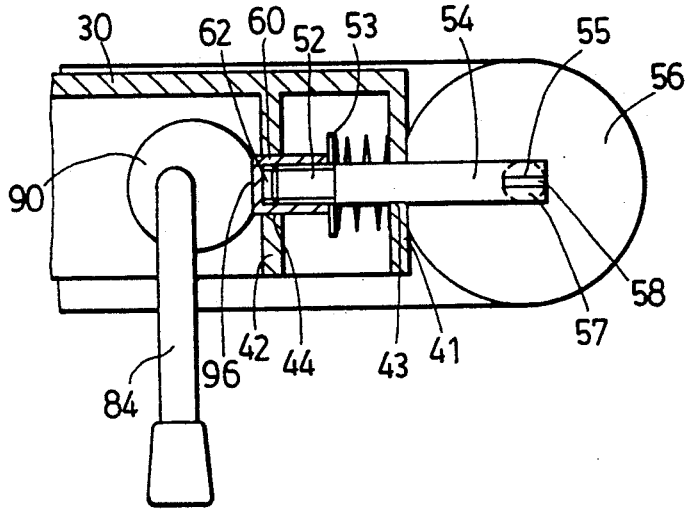
FIG. 4 shows a sectional view of the portion taken along the line 4—4 as shown in FIG. 2, with the sanding belt in a state of being tightened.

As shown in FIG. 4, as soon as the shaft 80 is rotated for a predetermined angle, the outer edge of the long axis of each of the cams 90 urges the inner end portion of each of the tubular sleeves 60. As a result, each of support rods 50 is forced to move axially and outwardly for a distance so as to actuate the driven roller 56 to move outwardly, thereby resulting in an increase in the distance between the driving roller 32 and the driven roller 56 in order to tighten the sanding belt 100 disposed on the outer edges of driving and driven rollers 32 and 56. The tightening of sanding belt 100 is secure in view of the fact that the tangential surface 96 of each of the cams 90 urges the inner end portion of each of the tubular sleeves 60.

Figure 5:
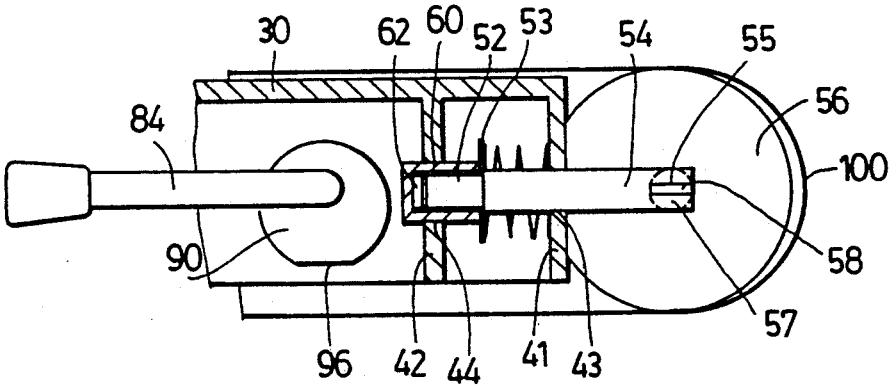
FIG. 5 shows a sectional view of the portion taken along the line 4—4 as shown in FIG. 2, with the sanding belt in a state of being released.

Now referring to FIG. 5, the shaft 80 is shown being rotated for an angle so as to actuate the long axial end of the cam 90 to separate from the inner end portion of the tubular sleeve 60. The support rod 50 is then forced to actuate the driven roller 56 to move inwardly by the tension of the coil spring 70 urging the first lug 41 and the washer 53. As a result, the distance between the driving roller 32 and the driven roller 56 is shortened so that the sanding belt 100 is released.

According to the present invention, two cams which rotate synchronously are used to urge the support rods to move outwardly. In addition, the inner end portion of each of support rods is fitted into a tubular sleeve, and each of support rods is encased with a coil spring. As a result, the motion of the driven roller will never deviate from the prescribed course of movement. It is therefore apparent that the belt roller adjustment device of belt sander of the present invention is superior to that of the belt sander of prior art.

What I claim is:

1. A belt roller adjustment device of belt sander comprising a machine seat provided at both ends thereof with a driven roller and a driving roller actuated by a motor, a sanding belt arranged on said rollers, two support rod seats disposed at opposite sides of said machine seat, and two support rods with inner end portions thereof being disposed inside said support rod seats and with outer end portions thereof having slots extending outside said support rod seats, both ends of the main shaft of said driven roller fastened in said slots, said belt roller adjustment device being characterized in that:

(a) said machine seat is further provided with two axial holes disposed coaxially on opposite sides thereof and with a shaft disposed pivotally between said axial holes in such a manner that an axis of said shaft is parallel to axes of said driving roller and said driven roller;

(b) said shaft is provided with two cams disposed thereon in such manner that they are positioned correspondingly to said inner end portions of said support rods, said two cams deflecting a predetermined angle in conjunction with said shaft so as to urge said inner end portions of said support rods;

(c) two elastic elements are disposed between said support rods and said support rod seats in such a way that they urge said support rods to move in a direction toward inner ends of said two elastic members;

(d) each of said inner end portions of said support rods having a threaded portion fitted over with a tubular sleeve having an inner end portion, said tubular sleeve adjustable so that said inner end portion is urged against an outer edge of said cam while a corresponding one of said two elastic members is maintained in compression;

(e) said two elastic elements being coil springs respectively enclosing said support rods in such a manner that their ends are positioned between the outer end portion of said tubular sleeves and the corresponding support rod seats;

(f) each of said cams having a flat surface located on an outer edge between the longest radii of said each of said cams to engage said inner end portion of said tubular sleeve; and (g) each of said support rod seats having a first lug and a second lug perpendicular to said machine seat; said first lug and said second lug having coaxial holes respectively slidably supporting said tubular sleeve and a corresponding one of said support rod, thereby facilitating said tubular sleeve being adjusted on said corresponding one of said support rods.

* * * * *